US010130162B2

(12) United States Patent
Tang

(10) Patent No.: US 10,130,162 B2
(45) Date of Patent: Nov. 20, 2018

(54) GEAR STRAP

(71) Applicant: Tim C. Tang, Carson, CA (US)

(72) Inventor: Tim C. Tang, Carson, CA (US)

( * ) Notice: Subject to any disclaimer, the term of this patent is extended or adjusted under 35 U.S.C. 154(b) by 188 days.

(21) Appl. No.: 15/213,381

(22) Filed: Jul. 18, 2016

(65) Prior Publication Data

US 2018/0014626 A1 Jan. 18, 2018

(51) Int. Cl.
*A45F 3/14* (2006.01)

(52) U.S. Cl.
CPC ..... *A45F 3/14* (2013.01)

(58) Field of Classification Search
CPC ..... A45F 3/14; A45F 2003/142
USPC ..... 24/579.09, 675
See application file for complete search history.

(56) References Cited

U.S. PATENT DOCUMENTS 3,601,863 A * 8/1971 Dorsey ..... B65D 63/16 24/16 PB
3,842,688 A * 10/1974 Baginski ..... B62M 3/083 24/16 PB
4,299,417 A * 11/1981 McClure ..... G09F 3/0358 292/320
4,389,754 A * 6/1983 Sohma ..... F16L 3/137 24/16 PB
5,704,097 A * 1/1998 Rahav ..... G09F 3/0352 24/16 PB
6,003,208 A * 12/1999 Christian ..... B65D 63/00 24/16 PB
6,311,531 B1 * 11/2001 Sykes ..... E05B 73/0017 24/16 PB
6,349,904 B1 * 2/2002 Polad ..... F16L 3/137 24/16 PB
6,823,566 B2 11/2004 Coffey
7,404,238 B2 * 7/2008 McNeill ..... B65D 63/1027 24/16 PB
2014/0096344 A1 * 4/2014 Creato ..... B65D 85/04 24/16 PB

* cited by examiner

*Primary Examiner* — Derek Battisti
(74) *Attorney, Agent, or Firm* — Edwin Tarver

(57) ABSTRACT

A releasable gear strap for retaining and securing articles has a locking head and a strap portion. The locking head has a retaining loop and a tab. The strap portion connects to the locking head and has a tail section. A pivoting locking member extends from the tail section of the strap portion, and includes a release cam surface and an aperture. The retaining loop and the tab are positioned on the locking head such that the release cam surface clears the retaining loop simultaneously with the tab seating in the aperture, when the tail section of the strap portion is urged through the retaining loop. A stabilizer on the locking head under the retaining loop and tab help reduce bending of the locking head.

20 Claims, 4 Drawing Sheets

GEAR STRAP

BACKGROUND

Selected gear components, including camping and hiking gear, tactical gear and other similar gear items are designed to be carried on the person of a user without encumbering the user's hands. Such gear items, including for example compasses, utility knives, flashlights, and even personal electronics typically have customized enclosures for storage and protection. Users frequently employ gear straps to affix the enclosures to a carrying apparatus, such as a belt, backpack, tactical vest, plate carrier, or similar carryall.

Gear straps specifically designed for carrying gear components are known in the art. Typically such straps comprise releasably closable continuous loops designed to secure a gear item or enclosure for a gear item to a clothing strap, belt, or similar worn piece of apparel. Gear straps currently in the art have several disadvantages. First, they are typically made of resilient materials that are difficult to flatten when formed into a loop. Since they do not lay flat, these gear straps allow a gear item to move around relative the belt, raising the likelihood of damage from shaking or by striking objects in unregulated motion.

Additional disadvantages of gear straps currently in the art is the inability to provide a closing connection that is both secure and easy to disengage. Straps with secure connectors are typically difficult to disconnect after use, even requiring specialized took to operate the closure, while straps that easily disconnect risk damage and loss to gear and equipment. Some gear straps have been developed having multiple moving components, requiring assembly for sale and use. While these straps may have connectors that are both resilient and easy to operate, they have the disadvantage of being prohibitively expensive to manufacture and assemble.

Thus there is a need for a gear strap that can be easily and inexpensively manufactured, preferably of unitary, molded construction. There is also a need for a gear strap which lays flat when connecting a gear item to a belt or similar carrying structure. There is also a need for a gear strap having a closure which is resilient, resisting inadvertent opening, but which is also easy to open, preferably with one hand.

SUMMARY

A releasable gear strap for retaining and securing articles, includes a locking head with a retaining loop and a strap portion extending from the locking head. The strap portion includes a head section connected to the locking head, and a tail section foldably connected to the head section. The locking head has a tab, and the retaining loop is located between the tab and the head section of the strap portion.

A pivoting locking member extends from the tail section of the strap portion, and has a release cam surface. An aperture is also formed in the tail section of the strap portion. The retaining loop and the tab are positioned on the locking head such that the release cam surface clears the retaining loop simultaneously with the tab seating in the aperture, when the tail section of the strap portion is urged through the retaining loop.

The locking head may include a stabilizer to reduce bending of the locking head. More specifically the locking head may have a top surface and an opposing bottom surface, with the retaining loop and the tab disposed on the top surface. In such a configuration, the stabilizer is disposed on the bottom surface. The stabilizer may also extend under the retaining loop and the tab at the same time.

Among other preferred structural details, the retaining loop may include a cutout sized to accommodate the pivoting locking member, and the strap portion may include a fold line between the head section and the tail section. Adjacent the fold line, opposing beveled portions may be located to facilitate folding. The tail section may include a grip for manipulating the strap portion, and a plurality of holes may be located on the head section of the strap portion.

In one alternative embodiment, a releasable gear strap for retaining and securing articles includes a substantially planar locking head with a top surface and an opposing bottom surface. A stabilizer is on the bottom surface, and a retaining loop and a tab are disposed on the top surface. In addition to the locking head, there is a strap portion including a head section and a tail section, with the head section extending from the locking head.

The retaining loop is disposed between the head section and the tab. The tail section includes an aperture for capturing the tab and a pivoting locking member. The pivoting locking member has a release cam surface extending away from the bottom surface for capturing the retaining loop so that the stabilizer is positioned to prevent the planar locking head from bending when the tail section is urged through the retaining loop to engage the tab.

The stabilizer may span the bottom surface, and optionally may extend under both the retaining loop and the tab. Optionally, the strap portion may have a fold line between the head section and the tail section, with opposing beveled portions adjacent the fold line. A grip may be incorporated into the tail section of the strap portion to promote ease of manipulation, and a plurality of holes may be incorporated into the head section of the strap portion for accommodating extra items or securing the gear strap in position.

In a third embodiment, a releasable gear strap for retaining and securing articles includes a substantially planar locking head with a top surface having a retaining loop and a tab, and an opposing bottom surface having a stabilizer. A strap portion extends from the locking head, and the strap portion includes a head section connected to the locking head and a tail section foldably connected to the head section.

The locking head also has a tab, with the retaining loop disposed between the tab and the head section of the strap portion. A pivoting locking member extends from the tail section of the strap portion and has a release cam surface. An aperture is also formed in the tail section of the strap portion. The retaining loop and the tab are positioned on the locking head such that the release cam surface clears the retaining loop simultaneously with the tab seating in the aperture when the tail section of the strap portion is urged through the retaining loop. A stabilizer may be included on the bottom surface, and may extend under both the retaining loop and the tab.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

Figure 1:
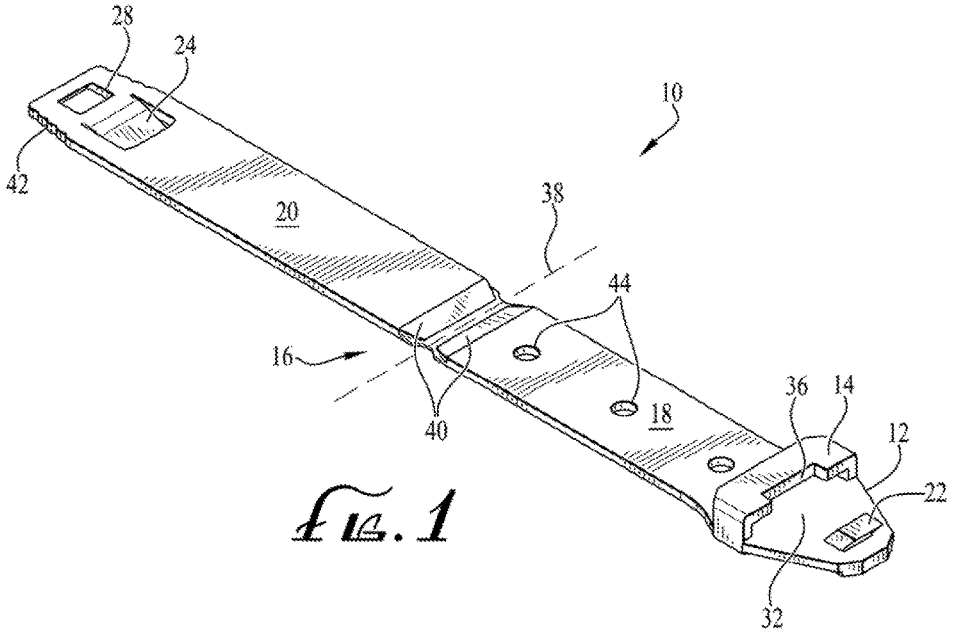
FIG. 1 illustrates a top perspective view of a gear strap.
Figure 2:
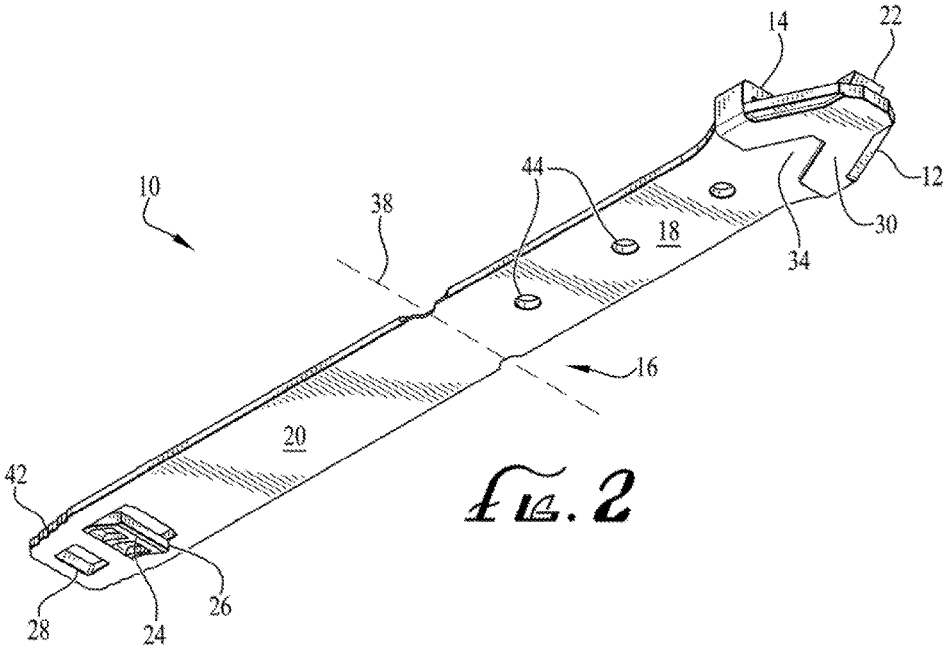
FIG. 2 illustrates a bottom perspective view of the gear strap.

Referring to FIGS. 1 and 2, a gear strap 10 for holding a gear item 50 (FIG. 4) when affixed to a belt 54 (FIG. 4), backpack (not shown) or similar item of carrying apparel is shown in an open configuration as it would appear when first molded. The gear strap 10 includes a locking head 12 with a retaining loop 14 and a strap portion 16 for engaging the locking head 12 when the gear strap 10 is closed and locked. The strap portion 16 includes a head section 18 connected to the locking head 12 and a tail section 20 connected to the head section 18. In various embodiments, the head section 18 may be coupled to the locking head 12 in a mechanically hinged manner allowing greater flexibility in relation to the strap portion 16.

The locking head includes a tab 22 for capturing the tail section 20. The tail section 20 includes a locking member 24 that pivots, extending away from the tail section 20. The pivoting locking member 24 includes a release cam surface 26 (FIG. 2) for engaging the retaining loop 14 on the locking head 12. The tail section 20 also includes an aperture 28 sized to accept the tab 22 on the locking head 12. The locking member 24 and the aperture 28 are positioned on the tail section 20 so that the release cam surface 26 engages the retaining loop 14 when the tab 22 is seated in the aperture 28.

A stabilizer 30 (FIG. 2) is incorporated on or coupled to the locking head 12, including being formed as part of the locking head 12 when the gear strap 10 is molded. In one preferred embodiment, the retaining loop 14 and the tab 22 are located on a top surface 32 (FIG. 1) of the locking head 12, while the stabilizer 30 is located on a bottom surface 34 (FIG. 2) of the locking head 12. The stabilizer 30 helps to prevent the locking head 12 from deforming as the tail section 20 is urged through the retaining loop 14 and up over the tab 22. As a consequence, the stabilizer 30 helps to urge the tab 22 through the tail section 20 once the tab 22 reaches the aperture 28.

In one preferred embodiment, the stabilizer 30 extends all the way across the locking head 12. In the illustrated embodiment, the stabilizer 30 extends across the locking head 12, and is formed in a specialized V shape, thereby positioning the stabilizer 30 so that it also extends under the tab 22 as well as the retaining loop 14. Such an arrangement creates increased resiliency, particularly at the tab 22, enhancing the stabilizer's 30 ability to urge the tab 22 through the tail section 20. Although the stabilizer 30 can be a separate structure affixed to the locking head 12, it is anticipated that the stabilizer 30 may be incorporated directly into the locking head 12 when the gear strap 10 is molded or otherwise formed.

To add resiliency and a solid fit when the tail section 20 is inserted into the retaining loop 14, a cutout 36 may be provided in the retaining loop 14. The cutout 36 is preferably of equal width as the pivoting locking member 24 and conforms to the pivoting locking member 24, ensuring that the release cam surface 26 abuts the cutout 36 preventing any lateral movement of the pivoting locking member 24 relative to the retaining loop 14. The cutout 36 also provides an effective area for preventing a user from inadvertently depressing the pivoting locking member 24 and releasing the tail section 20 from the locking head 12 unless opening the gear strap 10 is intended.

In its preferred use, the gear strap 10 is a flattened continuous loop, which is secured around a gear item 50 having a strap 52 and a belt 54, or similar item such as a backpack or gear bag strap, although the gear strap 10 may be fastened around any suitable structures. When installed, it is preferable that the gear strap 10 lay as flat as possible. In order to provide a substantially flattened loop shape, the strap portion 16 includes a fold line 38 substantially bisecting the strap portion 16 and dividing it evenly into the head section 18 and the tail section 20. In one embodiment, to assist with folding the strap portion 16 along the fold line 38, tare beveled portions 40 may be positioned on either side of the fold line 38 to reduce the thickness of the strap portion 16 adjacent the fold line 38.

In order to facilitate folding the tail section 20 over the head section 18, and inserting the tail section 20 through the retaining loop 14 on the locking head 12, the tail section 20 may include one or more grips 42. In the illustrated embodiment, the grips 42 are scalloped grips 42 molded directly into the tail section 20. To allow the gear strap 10 to hold other structures, such as a thin cord or to anchor the strap on a particular part of a gear item 50, several holes 44 are provided in the head section 18 of the strap portion 16.

Figure 3:
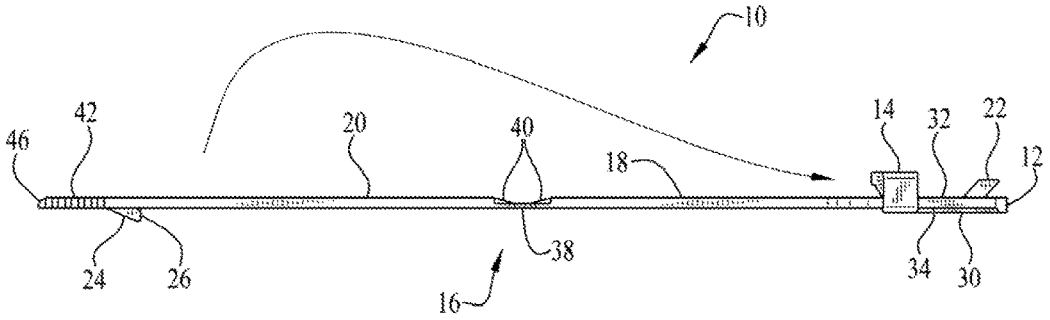
FIG. 3 illustrates a side elevational view of the gear strap, and the direction of folding to close and lock the gear strap.

Referring to FIG. 3, a side view illustrates how the gear strap 10 is manipulated when securing it on a gear item 50. The tail section 20 of the strap portion 16 is brought over the head section 18, and inserted through the retaining loop 14. To facilitate smooth movement of the tail section 20 over the tab 22, a rounded end 46 may be provided on the tail section 20. The rounded end 46 presents a curved profile to avoid the tail section 20 catching on the tab 22, which, extends at a steep angle from the locking head 12.

Figure 4:
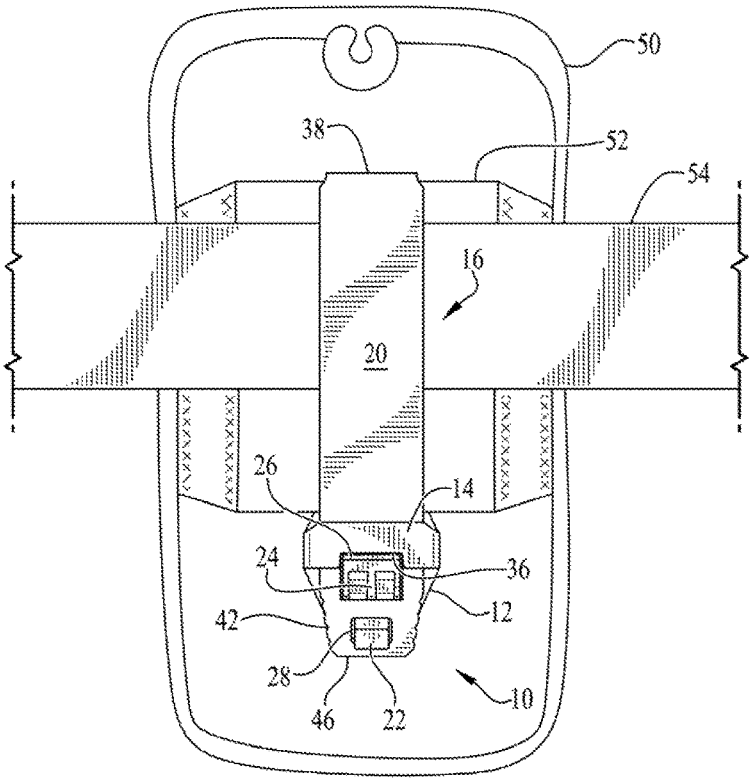
FIG. 4 illustrates the gear strap affixed to a belt and a gear item.

Referring to FIG. 4, the gear strap 10 is shown affixed to a gear item 50. The gear item 50 includes a band 52 encircled by the gear strap 10. The gear strap 10 also encircles a user's belt 54, thus holding the gear item 50 securely on the belt 54. In this view the head section 18 and the tail, section 20 encircle the band 52 of the gear item 50 and belt 54, with the head section 18 and the tail section 20 folded at the fold line 38. The tail section 20 is extended sufficiently through the retaining loop 14 such that the release cam surface 26 of the pivoting locking member 24 has engaged the retaining loop 14 and is held in the cutout 36, and the tab 22 is fully extended through the aperture 28, thus the tail section 20 is prevented from disengaging the locking head 12.

Figure 5:
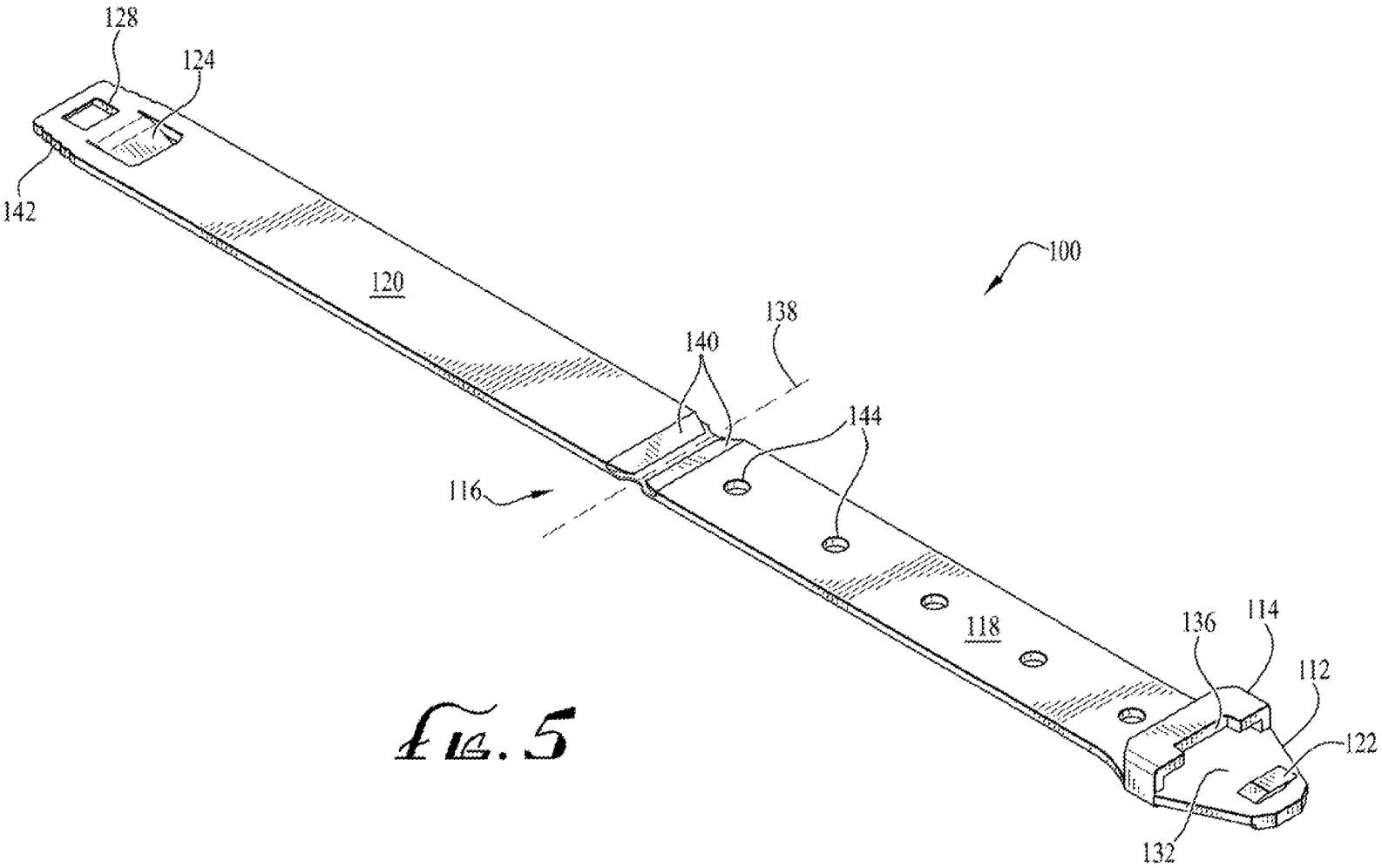
FIG. 5 illustrates a top perspective view of a second embodiment gear strap.
Figure 6:
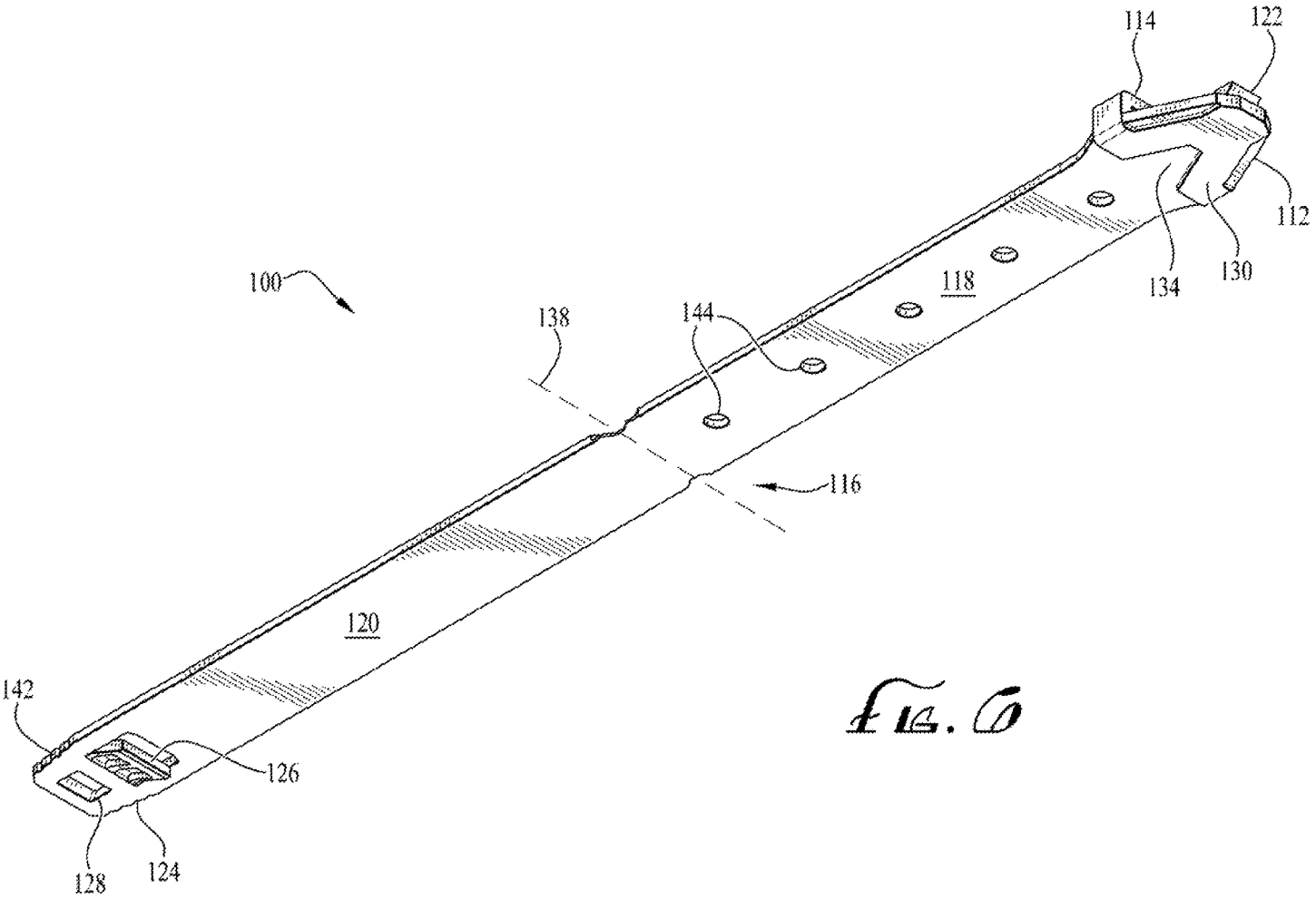
FIG. 6 illustrates a bottom perspective view of the second embodiment gear strap.

Referring to FIGS. 5 and 6, a second embodiment gear strap 100 is shown, reflecting that multiple embodiments of the gear strap, 10, 100 can be made in a variety of sizes, without deviating from its overall structure. The second embodiment gear strap 100 includes a locking head 112 with a top surface 132 (FIG. 5) and bottom surface 134 (FIG. 6), retaining loop 114, cutout 136, tab 122, and stabilizer 130 (FIG. 6), and a strap portion 116 with a head section 118 and tail section 120, a pivoting locking member 124 with release cam surface 126 (FIG. 6), aperture 128, fold line 138, bevels 140 (FIG. 5), grip 142, and holes 144. In larger embodiments, such as the second embodiment gear strap 100, a greater number of holes 144 may be present since more space is provided on the head section 118 of the strap portion 116.

The structure and components of the first embodiment gear strap 10 and second embodiment gear strap 100 having been shown and described, their method of operation will now be discussed. For purposes of discussion, only the first embodiment gear strap 10 is referenced since the second embodiment gear strap 100 has substantially the same method of operation. Also for purposes of discussion, the act of affixing a gear item 50 to a belt 54 is discussed, although it is to be understood that the gear strap 10 may connect many different items in various arrangements.

To employ the gear strap 10, a user obtains the gear strap 10 in the flat, open configuration shown in FIGS. 1-3. Since the gear strap 10 is preferably of one-piece unitary construction, it may be created by molding it in the open configuration using a resilient but pliable plastic-like material. The user takes the gear strap 10 and inserts the strap portion 16 under a band 52 of a gear item 50 and belt 54, sliding it sufficiently far under the band 52 and belt 54 such that only the head section 18 lies under the band 52 and belt 54. In various embodiments, the holes 44 may be placed on a rivet or screw (not shown) for more permanent attachment of the gear strap 10 to a gear item 50, and more firmly hold the gear strap 10 against the gear item 50, further resisting unwanted movement.

With the gear strap 10 in position on the gear item 50 and belt 54, a user bends the tail end 20 over band 52 and belt 54, folding the strap portion 16 along the fold line 38 in the process. To help with this process, the user may grasp the tail end by the grip 42. The user aligns the tail end 20 with the head end 18 and brings it toward the locking head 12, passing the tail end 20 through the retaining loop 14. As the tail end continues extending through the retaining loop 14, the rounded end 46 eventually encounters the tab 22.

With the tab angled away from the strap portion to 16, the round end 46 travels up the tab 22. To keep pressure on the tail end 20 by the tab 22, stabilizer 30 prevents the locking head from deflecting away from the tail end 20. Also as the tail end 20 slides through the retaining loop 14, the pivoting locking member 24 passes under the retaining loop 14 deflecting the pivoting locking member 24 in the process. At a point beyond where the locking, member 24 clears the retaining loop 14, the tab 22 becomes fully aligned with the aperture 28, allowing the aperture 28 to slide down onto the tab 22.

Because the tab 22 is angled, as the aperture 28 slides down the tab 22, the tail section 20 slides slightly backwards. When the aperture 28 is fully inserted over the tab 22 such that the tail section 20 encounters the top surface 32, the release cam surface 26 preferably simultaneously meets the retaining loop 14, and is held in the cutout 36. With the tail section 20 retained by the locking head 12, and the gear strap 10 securing the band 52 of the gear item 50 to the belt 54, a user may move about without worrying that the gear item 50 will inadvertently dislodge from the belt 54.

When a user desires to remove the gear item 50 from the belt 54, the user lifts the tail section 20 sufficiently so that the aperture 28 clears the tab 22. In the process, the angled nature of the tab 22 urges the tail section 20 forward, separating the release cam surface 26 from the cutout 36. That action allows the user to depress the pivoting locking member 24 (easily with the same hand if desired). With the aperture 28 disengaged from the tab 22, allows the tail section 20 to slide back through the retaining loop 14. Once the tail section 20 clears the retaining loop 14, the strap portion 16 can be unfolded and removed, allowing the gear item 50 and belt 54 to be decoupled. The process can be repeated whenever a user desires to employ the gear strap 10 again.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. A releasable gear strap for retaining and securing articles, the releasable gear strap comprising:

a locking head comprising a retaining loop;

a linear strap portion extending from the locking head, wherein the strap portion comprises a head section extending from the locking head, and a tail section foldably connected to the head section;

the locking head further comprising a tab, the retaining loop disposed between the tab and the head section of the strap portion;

a pivoting locking member extending from the tail section of the strap portion, the pivoting locking member having a release cam surface; and an aperture formed in the tail section of the strap portion, wherein the retaining loop and the tab are positioned on the locking head such that the release cam surface clears the retaining loop simultaneously with the tab seating in the aperture when the tail section of the strap portion is urged through the retaining loop.

2. The releasable gear strap of claim 1 wherein the locking head comprises a stabilizer to reduce bending of the locking head.

3. The releasable gear strap of claim 2 wherein the locking head comprises a top surface and an opposing bottom surface, with the retaining loop and the tab disposed on the top surface.

4. The releasable gear strap of claim 3 wherein the stabilizer is disposed on the bottom surface.

5. The releasable gear strap of claim 4 wherein the stabilizer extends under the retaining loop and the tab.

6. The releasable gear strap of claim 1 wherein the retaining loop comprises a cutout sized to accommodate the pivoting locking member.

7. The releasable gear strap of claim 1 wherein the strap portion comprises a fold line between the head section and the tail section.

8. The releasable gear strap of claim 7 further comprising opposing beveled portions adjacent the fold line.

9. The releasable gear strap of claim 1 wherein the tail section further comprises a grip for manipulating the strap portion.

10. The releasable gear strap of claim 1 further comprising a plurality of holes on the head section of the strap portion.

11. A releasable gear strap for retaining and securing articles, the releasable gear strap comprising:

a substantially planar locking head comprising a top surface and an opposing bottom surface;

a stabilizer on the bottom surface;

a retaining loop and a tab disposed on the top surface;

a strap portion comprising a head section and a tail section, the head section extending from the locking head;

the retaining loop disposed between the head section and the tab;

the tail section comprising an aperture for capturing the tab and a pivoting locking member the pivoting locking member comprising a release cam surface extending away from the bottom surface for capturing the retaining loop; and wherein the stabilizer is positioned to prevent the planar locking head from bending when the tail section is urged through the retaining loop and engages the tab.

12. The releasable gear strap of claim 11 wherein the stabilizer spans the bottom surface.

13. The releasable gear strap of claim 11 wherein the stabilizer extends under both the retaining loop and the tab.

14. The releasable gear strap of claim 11 wherein the strap portion comprises a fold line between the head section and the tail section.

15. The releasable gear strap of claim 11 further comprising opposing beveled portions adjacent the fold line.

16. The releasable gear strap of claim 11 further comprising a grip on the tail section of the strap portion.

17. The releasable gear strap of claim 11 further comprising a plurality of holes on the head section of the strap portion.

18. A releasable gear strap for securing articles, the releasable gear strap comprising:

a substantially planar locking head comprising a top surface having a retaining loop and a tab, and an opposing bottom surface having a stabilizer;

a strap portion extending from the locking head, wherein the strap portion comprises a head section connected to the locking head, and a tail section foldably connected to the head section;

the locking head further comprising a tab, the retaining loop disposed between the tab and the head section of the strap portion;

a pivoting locking member extending from the tail section of the strap portion, the pivoting locking member having a release cam surface; and an aperture formed in the tail section of the strap portion, wherein the retaining loop and the tab are positioned on the locking head such that the release cam surface clears the retaining loop simultaneously with the tab seating in the aperture when the tail section of the strap portion is urged through the retaining loop.

19. The releasable gear strap of claim 18 further comprising a stabilizer on the bottom surface.

20. The releasable gear strap of claim 19 wherein the stabilizer extends under both the retaining loop and the tab.

* * * * *